United States Patent [19]

Palmer et al.

[11] Patent Number: 4,937,959

[45] Date of Patent: Jul. 3, 1990

[54] POSTER DISPLAY DEVICE WITH LONGITUDINAL RETENTION OF FRAME SECTIONS

[75] Inventors: Randall Palmer, Farmington Hills; David U. Hillstrom, Novi, both of Mich.

[73] Assignee: Marketing Displays, Inc., Farmington Hills, Mich.

[21] Appl. No.: 25,398

[22] Filed: Mar. 13, 1987

[51] Int. Cl.[5] ..... G09F 1/12

[52] U.S. Cl. ..... 40/156

[58] Field of Search ..... 40/647, 156, 152

[56] References Cited

U.S. PATENT DOCUMENTS

| | | | |
|---|---|---|---|
| 1,607,465 | 11/1926 | Kirk et al. | 40/156 |
| 3,070,914 | 1/1963 | Henderson et al. | 40/156 |
| 3,205,601 | 9/1965 | Gawne et al. | 40/156 |
| 3,310,901 | 3/1967 | Sarkisian | 40/156 |
| 3,360,893 | 1/1968 | Wattelez | 52/105 |
| 3,386,198 | 6/1968 | Howell | 40/156 |
| 3,662,482 | 5/1972 | Sarkisian | 40/602 |
| 3,720,979 | 3/1973 | Krawagna | 16/150 |
| 3,745,680 | 7/1973 | Faust | 40/156 |
| 3,885,335 | 5/1975 | Egermayer | 40/156 |
| 4,038,770 | 8/1977 | Bott | 40/209 |
| 4,094,083 | 6/1978 | Fund | 40/536 |
| 4,145,828 | 3/1979 | Hillstrom | 40/156 |
| 4,235,030 | 11/1980 | Astolfi | 40/156 |
| 4,237,632 | 12/1980 | Segerstad | 40/156 |
| 4,358,917 | 11/1982 | Oda et al. | 52/717 |
| 4,364,192 | 12/1982 | Lloyd | 40/155 |
| 4,512,094 | 4/1985 | Seely | 40/156 |
| 4,512,095 | 4/1985 | Seely | 40/156 |
| 4,523,400 | 6/1985 | Seely | 40/156 |
| 4,580,361 | 4/1986 | Hillstrom et al. | 40/603 |
| 4,702,025 | 10/1987 | Mace | 40/647 |

FOREIGN PATENT DOCUMENTS

| | | |
|---|---|---|
| 97398A | 10/1960 | Netherlands . |
| 328624 | 4/1958 | Switzerland . |
| 519632 | 4/1940 | United Kingdom . |
| 893632 | 4/1962 | United Kingdom . |
| 1056999 | 2/1967 | United Kingdom . |
| 1295378 | 11/1972 | United Kingdom . |
| 1404624 | 9/1975 | United Kingdom . |
| 2005535 | 4/1979 | United Kingdom . |
| 2142459A | 1/1985 | United Kingdom . |

*Primary Examiner*—Cary E. Stone

*Attorney, Agent, or Firm*—Brooks & Kushman

[57] ABSTRACT

An improved poster frame and display holder for replaceable posters and similar advertising material is disclosed. The sides of the frame include sets of pivotably engaged extruded metal, molded plastic, or other front and back frame members. Improved leaf-type springs bias together the front and back members of each side of the frame for releasably holding a poster or similar display. Interlocking portions of the front and back members substantially prevent relative longitudinal movement therebetween.

37 Claims, 4 Drawing Sheets

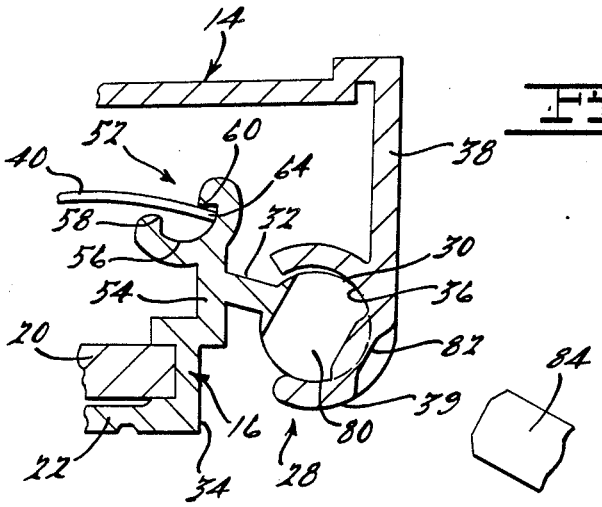
FIG. 5.
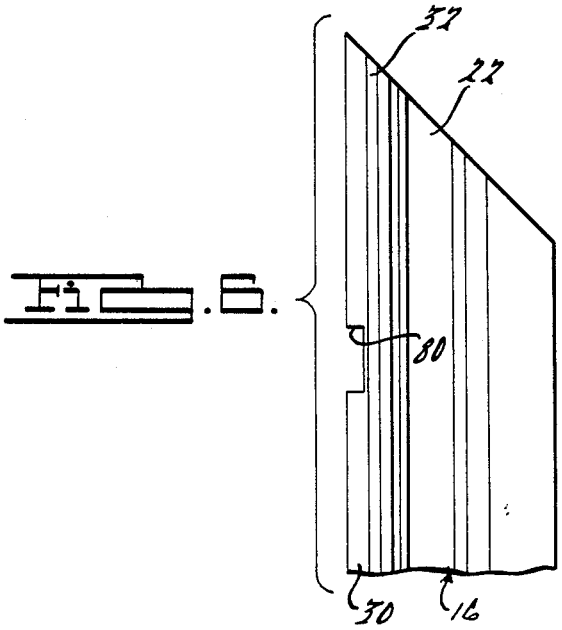
FIG. 6.
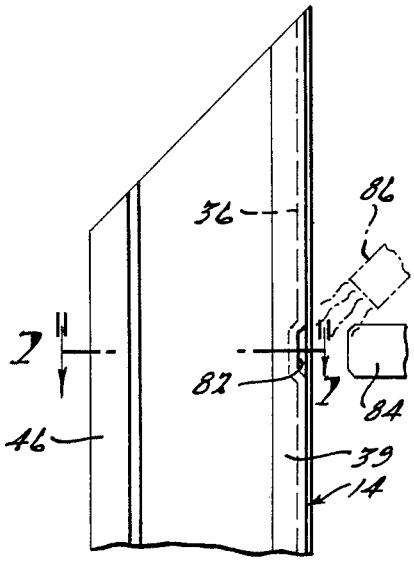
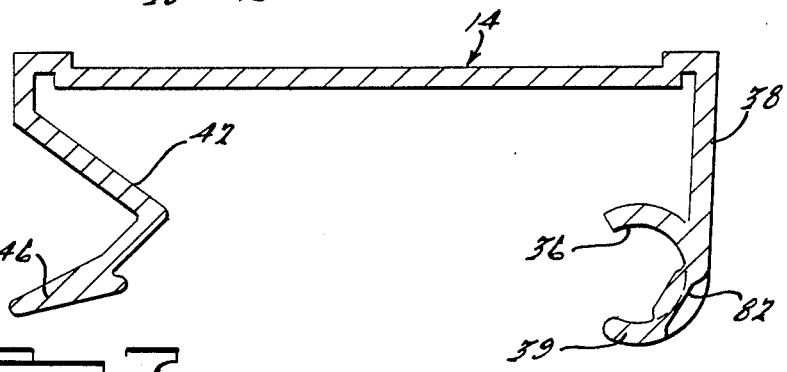
FIG. 7.

POSTER DISPLAY DEVICE WITH LONGITUDINAL RETENTION OF FRAME SECTIONS

BACKGROUND AND SUMMARY OF THE INVENTION

The present invention relates to an improved poster frame and display holder for various types of replaceable posters and similar advertising materials. The frame and holder can be utilized in various indoor and outdoor areas, such as on buses, street cars, taxicabs, and similar mobile installations, as well as on fixed mounts such as a service stations, on building walls, on posts and the like.

The present inventions is an improvement over the invention disclosed and claimed in U.S. Pat. Nos. 4,145,828; and 3,310,901, and is also related to U.S. Pat. Nos. 4,580,361; 4,523,400; 4,519,152; 4,512,095; 4,512,094; and 4,138,787, all of which are owned by the assignee of the present invention, and the disclosures of which are all incorporated by reference herein.

In accordance with the present invention, a display holder includes a plurality of generally elongated frame sections, which can be fabricated from extruded metal members, molded plastic members, or other suitable materials. Each frame section includes a front and back member adapted to be assembled in an interconnected arrangement, and preferably pivotally interconnected for relative pivotal movement throughout a range of relatively pivoted positions. One of the front and back members has a laterally recessed portion formed at a predetermined longitudinal position therein, and the other of the front and back members has a laterally-protruding discontinuity formed at a longitudinal position thereon corresponding to the longitudinal position of the recessed portion on the first member when the front and back members are assembled. The laterally-protruding discontinuity is longitudinally interlockingly received in the laterally recessed portion in order to substantially prevent sliding or other longitudinal movement of the front and back members relative to one another when assembled. In the preferred pivotally interconnected arrangement, such longitudinally interlocking relationship is maintained throughout the range of relative pivotal movement. In some of the preferred embodiments, at least the laterally-protruding discontinuity is formed without creating an opening through the material of the front or back member on which it is formed, thus avoiding the entry of water, dist, or other foreign elements into the assembly.

Preferably, the laterally-protruding discontinuity is formed after the front and back members are assembled in order to substantially assure alignment with the laterally recessed portion. The laterally-protruding discontinuity can be formed by staking, punching or cutting, for example, by heating and deforming in plastic components. Alternately, either or both of the laterally-protruding discontinuity and the laterally recessed portion can be molded or otherwise formed prior to assembly and then snapped into the above-mentioned interlocking relationship during assembly of the front and back members.

Other objects, features and advantages of the invention will become apparent from the following description of the invention when viewed in conjunction with the accompanying drawings and claims.

BRIEF DESCRIPTION OF THE DRAWINGS

FIG. 3 is a cross-sectional view taken along line 3—3 of FIG. 1.

FIG. 5 is a detailed partial cross-sectional, similar to that of FIG. 3, but illustrating a longitudinal retention arrangement for the front and back members of the display holder frame sections in accordance with the present invention.

FIG. 6 is a partial detail view of the front and back frame members, shown separated from one another and further illustrating the retention arrangement of FIG. 5.

FIG. 7 is a cross-sectional view taken generally along line 7—7 of FIG. 6.

DETAILED DESCRIPTION OF THE PREFERRED EMBODIMENTS

Figures 1, 2:
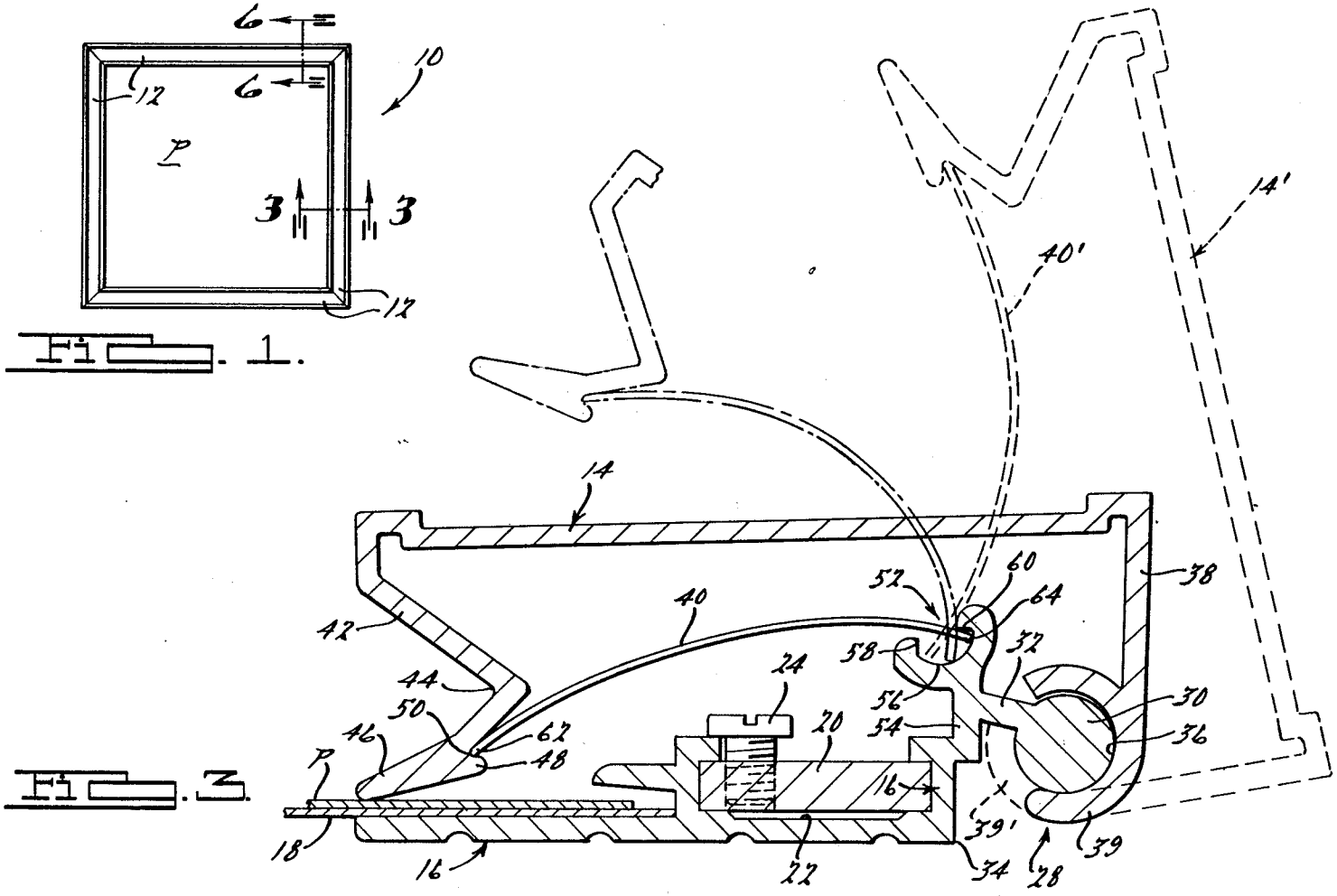
FIG. 1 is a front view of an improved display holder in accordance with the present invention.
FIG. 2 is a fragmentary perspective view of a corner section of the display holder shown in FIG. 1.
Figure 2:
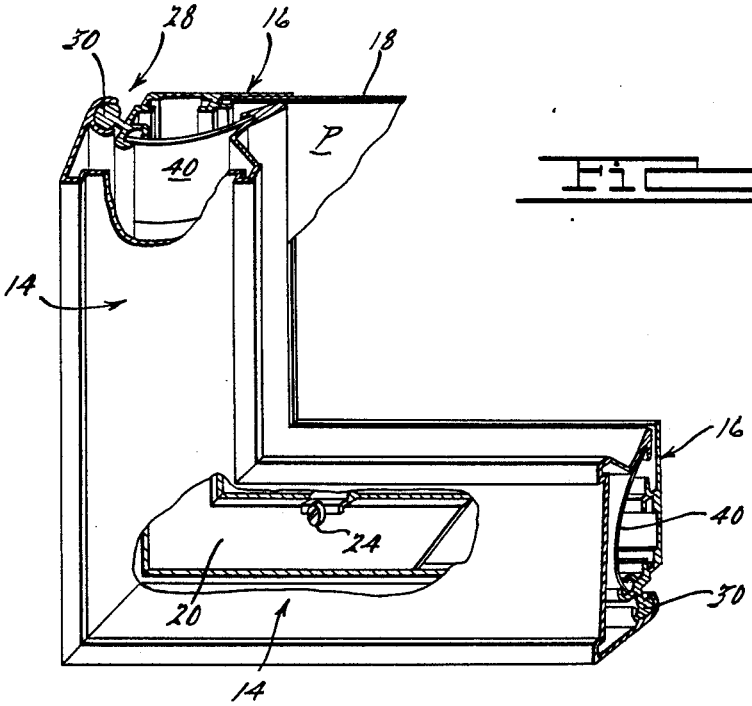

As illustrated in FIG. 1, an exemplary display holder and poster frame, generally designated by the reference numeral 10, is made up of a plurality of frame sections 12. As shown in FIGS. 2 and 3, each of the frame sections 12 are made essentially of two elongated members 14 and 16 which are preferably pivoted together. The respective front and back members 14 and 16 of each section 12 are cut to the desired length and mitred at 45 degree angles at their opposite ends for abutting and coplanar assembly with one another to outline the frame 10. As will be understood, the frame 10 is typically square or rectangular, although it is also possible for the frame 10 to have any desired polygonal or other shape with an appropriate number of sections 12 mitred at appropriate angles. Also, it is possible for each of the front or cover members 14 to be comprised of a number of extruded pieces of shorter length positioned end-to-end, for example.

The display holder and frame 10 preferably includes a rigid backing member 18 which can be made of Masonite, aluminum or another suitable material, with the frame sections 12 positioned around the edges of the backing member 18 to form the completed display holder. A poster P or other display member is positioned on the backing member 18 and held in place around its edges by the frame sections 12. The back member 16 can be fastened in any conventional means to a rigid supporting member, such as a post, wall or the like. Although preferred in most applications, the backing member 18 is not necessary in all situations, since the display holder and frame 10 can also be mounted on a flat surface forming its own backing member, or the poster P could be made of a rigid or stiff material that does not require a backing member for support.

The front and back members 14 and 16 are preferably made of a material which can be efficiently and economically extruded, molded, or otherwise suitably fabricated, which presents and attractive external appearance, and which maintains a pleasing and durable structure for an indefinite length of time. Suitable materials include plastic, aluminum and magnesium, for example.

Adjacent sections 12 of the frame 10 can be held and fastened together by corner braces 20, or by other suitable means known to those skilled in the art. The braces 20 are positioned in suitable recesses 22 in each of the back members 16 and held in place by screws 24, or otherwise suitably secured.

The outer or front member 14 of each frame section 12 is assembled to the back member 16 by means of a high assembly 28. The hinge assembly 28 is comprised of a cylindrical hinge or pivot pintle formation 30 that is held in an outwardly offset relationship by a bridge element 32 from the back wall 34 of the back member 16 and a corresponding cup-shaped socket portion 36 formed on the back panel 38 of the front member 14. The edges of the cup 36 preferably extend more than 180 degrees about the pivot pintle 30 and the two members 14 and 16 thus are either slidably assembled in the longitudinal direction or snapped together.

As shown by the dashed phantom lines in FIG. 3, the hinge assembly 28 allows the front or cover member 14 to pivot relative to the back member 16. When the front or cover member 14 is in the position shown in solid lines in FIG. 3, it holds the poster P in position in the frame against the backing member 18. When the poster P is to be removed or replaced, the front member 14 is rotated to the pivoted position 14', thus permitting removal of the poster P. The rotation of the front member 14 is preferably limited by stop end 39 of back panel 38, and thus when the front member 14 is swung to its fully open position 14', the stop end 39 rests against the bridge element 32 (as shown by numberal 39' is FIG. 3).

One or more leaf springs 40 are positioned and resiliantly deflected in each section 12 between the front and back members 14 and 16. The springs 40 act to maintain a snug mating pivotal engagement of members 14 and 16 and to bias the front members 14 against the poster P and the backing member 18 when the frame sections 12 are "closed," as well as holding the front members 14 in their "open" upright position (14' in FIG. 3) for removal or replacement of poster P. The springs 40 are preferably composed of spring steel and have a generally flat, rectangular shape in their free state.

The front member 14 has a side panel 42 with a longitudinal groove 44 formed therein so that the front member 14 may be grasped, and opened or closed relative to the back member 16. The end 46 of side panel 42 is adapted to rest on the poster P and clamp it in place in the display holder. An outwardly and upwardly hook portion 48 is provided adjacent the end 46 to form a longitudinal groove or recess 50 within which one end 62 of the spring 40 is positioned when the front and back members 14 and 16 are assembled together and the spring 40 is installed in place. The groove 50 has sufficient depth to retain the end 62 of spring 40 when the front member 14 is opened and closed.

The opposite end 64 of the spring 40 is positioned in an arcuately-shaped channel 52 formed in the upstanding flange portion 54 of the back 16. The channel 52 extends longitudinally in the back member 16, and has an arcuate portion 56 extending through an arc of approximately 90-degrees. The arcuate portion 56 is bounded on its two sides by flat walls 58 and 60, the planes of which are substantially perpendicular to each other. The shape and position of the channel 52 allows unrestricted movement of end 64 of spring 40 over a 90-degree arc as the front member 14 is opened and closed and also prevents the end 64 from being displaced therefrom. The channel 52 further allows use of a flat spring 40, which can be easily manufactured without expensive and time-consuming roll forming and bending, which does not require stringent manufacturing tolerances, and which can be quickly and easily installed in the frame sections 12.

In the assembly of the frame sections 12, the front and back members 14 and 16 are first longitudinally slid or snapped together at the hinge assembly 28. The front member 14 is then fully swung to its open position (14' in FIG. 3), as limited by the stop end 39, and the end 64 of spring 40 is positioned in the arcuate channel 52. A force is then applied to the spring 40 until its end 62 thereof is slid past the end of hook formation 48 and snapped into its final position in groove 50.

Figure 4:
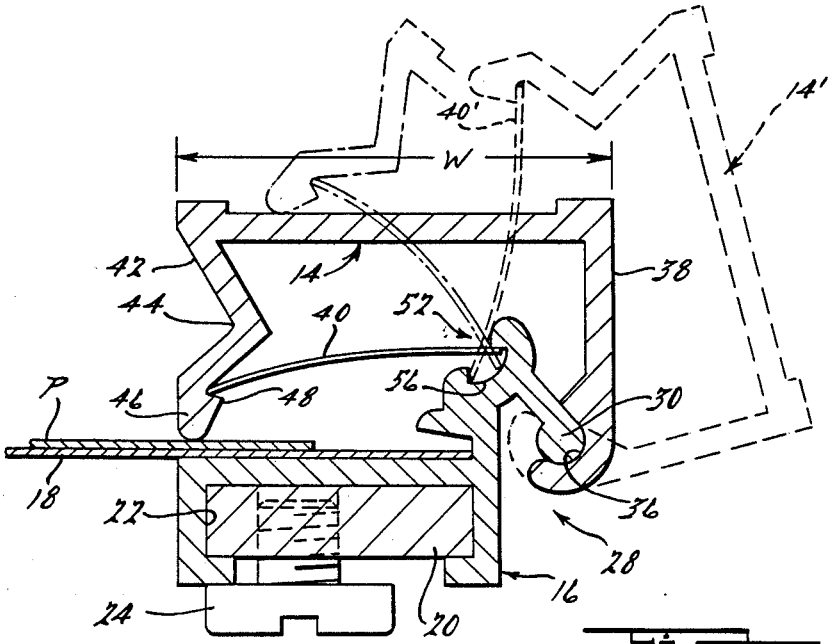
FIG. 4 is a partial cross-sectional view similar to that of FIG. 3, but illustrating of another embodiment of the present invention.

Another embodiment of the invention is shown in FIG. 4 and is designed for small frame applications. Most of the parts of the frame shown in FIG. 4 are similar to those above-described with reference to FIGS. 1 through 3, and are thus indicated by similar reference numerals. The primary differences between the embodiments of FIGS. 1 through 3 and FIG. 4 are the widths W of the front and back members 14 and 16 and the positioning of the brace 20 in the recess 22. The unique arrangement of the spring 40 and mating recesses described above allow the frame sections to be very small, with a width W on the order of three-quarters of an inch, while still allowing the frame sections to operate in the same manner as much larger frame sections.

The foregoing discussion provides a general description of the display holder assembly disclosed and claimed in the above-mentioned U.S. Pat. No. 4,145,828 for purposes of illustration. As will be readily appreciated by one skilled in the art, the improvement provided by the present invention is equally equable to frames or display holders other than that shown for purposes of illustration on the drawings, including many of the frame and display holder assemblies disclosed in the various United States patents listed above and incorporated by refrence herein, or variations thereon.

In FIGS. 5 through 7, a retention arrangement for preventing relative longitudinal sliding or other movement of the front and back members 14 and 16 is illustrated. The socket portion 36 of the front member 14 has a laterally-protruding dimple or discontinuity 82 formed therein at a longitudinal position corresponding to the longitudinal position of a laterally recessed slot or other recessed portion 80 formed in the pintle portion 30 of the back member 16. When the front and back members 14 and 16 are assembled, as shown in FIG. 1 through 4, the discontinuity 82 is longitudinally interlockingly received within the laterally recessed portion 80 in order to prevent the front and back members 14 and 16 from being longitudinally moved out of alignment relative to one another.

Preferably, the discontinuity 82 is formed in the front member 14 without shearing or otherwise creating an opening through the material of the socket portion 36 in order to substantially avoid the entry of water, dust, debris, or other foreign materials into the frame section assembly. Likewise, the laterally recessed slot 80 is preferably formed in the back member 16 so as to avoid creating an opening that extends all the way through the material of the back member 16. Rather, the laterally recessed slot 80 is preferably cut, molded, or otherwise formed partially through the pintle portion 30. In this regard, it should be noted that a similar laterally recessed portion can be formed in the socket portion 36 of the front member 14, and a similar laterally-outwardly protruding discontinuity can be formed on the pintle portion 30 of the back member 16, in lieu of the opposite arrangement depicted in FIGS. 5 through 7.

Preferably, the shape and configuration of the discontinuity 82 and the laterally recessed slot 80 are such that their longitudinally interlocking relationship is maintain throughout the full range of pivotal movement of the front and back members 14 and 16 relative to one another. By such an arrangement, the above-mentioned longitudinally interlocking retention of the front and back members 14 and 16 is retained during all modes of operation or function of the display holder 10.

Preferably, the retention arrangement for the display holder 10 is fabricated by first forming the laterally recessed slot 80 at its predetermined longitudinal position on the back member 16, assembling the front and back members 14 and 16 as shown in FIGS. 1 through 4, and then forming the laterally-protruding discontinuity 80 at the corresponding longitudinal position on the front member 14. By following such a fabrication and assembly procedure, it is substantially assured that the discontinuity 82 will be properly aligned with the laterally recessed slot 80 when the front and back members 14 and 16 are assembled.

The formation of the discontinuity 82 can be accomplished in any of a number of ways known to those skilled in the art, such as by laterally deforming a portion of the socket 36 of the front member 14 by way of a staking operation using a staking tool (diagrammatically illustrated by reference numeral 84 in FIG. 6). Alternately, if the front and back members 14 and 16 are composed of a molded plastic material, the laterally recessed slot 80 can be molded into the back member 16, the members 14 and 16 can be assembled, and the discontinuity 82 can be formed thereafter by heating a portion of the front member 14, using a heat source illustrated diagrammatically in FIG. 6 by reference numeral 86, and then laterally deforming the heated portion inwardly by way of the staking tool 84 or other such suitable deformation tools known to those skilled in the art. In still another alternate construction, wherein the front and the back members 14 and 16 are composed of a moldable plastic material, both the laterally recessed slot 80 and the laterally-protruding discontinuity 82 can be formed during the molding of their respective numbers 16 and 14, and then snapped into their above-discussed longitudinally interlocking relationship during the interconnection of the front and back members 14 and 16.

Many of the fabrication or forming techniques described above can also be employed in the above-mentioned alternate arrangement, wherein the laterally-protruding discontinuity 82 is formed in the back member 16, and a corresponding laterally recessed slot 80 is formed in the front member 14.

Figure 8:
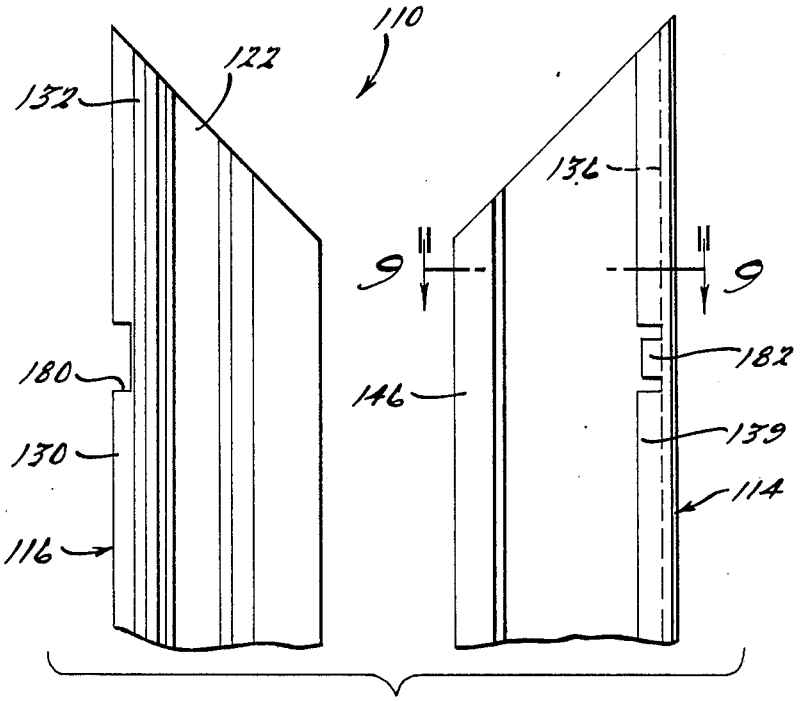
FIG. 8 is a partial detail view similar to that of FIG. 6, but illustrating an alternate longitudinal retention arrangement for the front and back members.
Figure 9:
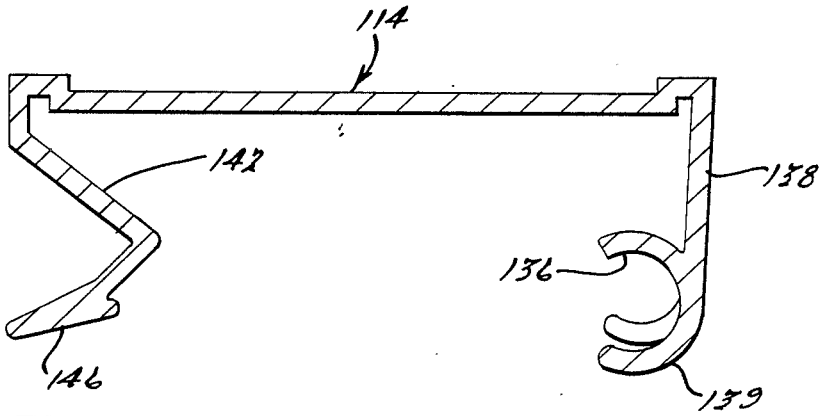
FIG. 9 is a cross-section view taken generally along line 9—9 of FIG. 8.

FIGS. 8 and 9 illustrates still another alternate arrangement according to the present invention, wherein a display holder 110 is generally similar to the display holder 10 described above in connection with FIGS. 1 through 7, with similar or corresponding elements and components thereof indicated by reference numeral similar to those of FIGS. 1 through 7, but having a one-hundred prefix. In FIGS. 8 and 9, a laterally-protruding tab or other discontinuity 182 is cut and formed into the socket portion 130 of the front member 114, in place of the staked or dimpled discontinuity 82 shown in FIGS. 5 through 7. In other respects, the alternate arrangement shown in FIGS. 8 and 9 is substantially similar, both in configuration and function, to that shown in FIGS. 5 through 7. Similarly, one skilled in the art will readily recognize that the relative positions of the discontinuity 182 on the front member 114, and the laterally recessed slot 180 on the back member 116, can optionally be reversed such that the discontinuity 182 is formed in the back member 116, and the laterally recessed slot 180 is formed in the front member 114.

The foregoing discussion discloses and describes exemplarily embodiments of the present invention. On skilled in the art will readily recognize from such discussion, and from the accompanying drawing and claims, the various changes, modifications, and variations made be made therein without departing from the spirit and scope of the invention as defined in the following claims.

What is claimed is:

1. In a display holder having a plurality of elongated frame sections forming a frame structure for receiving and holding a display piece, each of said sections having a pair of elongated front and back members adapted to be assembled in an interconnected arrangement with one another, said front and back members being provided with coacting hinge formations integral therewith and in mating pivotal engagement with one another, the improvement wherein in said coacting hinge formations one of said elongated front and back members has a laterally recessed portion formed at a predetermined longitudinal position therein, the other of said elongated front and back members having a laterally-protruding discontinuity formed at a longitudinal position thereon corresponding to said predetermined longitudinal position of said laterally recessed portion when said front and back members are in said interconnected arrangement, said laterally-protruding discontinuity being longitudinally interlockingly received within said laterally recessed portion in order to provide a longitudinally interlocking interference and to substantially prevent longitudinal movement of said front and back members relative to one another when in said interconnected arrangement.

2. The invention according to claim 1, wherein said elongated front and back members are adapted to be assembled in a pivotal relationship relative to one another for relative pivotal movement throughout a range of relatively pivoted positions, said laterally-protruding discontinuity being longitudinally interlockingly received in said laterally recessed portion in order to provide said longitudinally interlocking interference and to substantially prevent said relative longitudinal movement throughout said range of relatively pivoted positions.

3. The invention according to claim 1, wherein said display holder is fabricated by first forming said laterally recessed portion at said predetermined longitudinal position in said one of said elongated front and back members, assembling said front and back members in said interconnected arrangement, and forming said laterally-protruding discontinuity at said corresponding longitudinal position on said other of said elongated front and back members after said assembly in order to substantially assure that said laterally-protruding discontinuity is longitudinally interlockingly received in said laterally recessed portion when said front and back members are assembled in said interconnected arrangement.

4. The invention according to claim 3, wherein said laterally-protruding discontinuity is formed by a staking operation in order to yieldably deform a portion of the material of said other of said elongated front and back members in a lateral direction toward said recessed portion on said one of said elongated front and back members.

5. The invention according to claim 3, wherein said laterally-protruding discontinuity is formed by an operation including heating a portion of the material of said other of said elongated front and back members at said corresponding longitudinal position thereon, and yieldably deforming said heated portion in a lateral direction toward said recessed portion on said one of said elongated front and back members.

6. The invention according to claim 5, wherein said elongated front and back members are formed by molding a moldable plastic material.

7. The invention according to claim 6, wherein at least said laterally recessed portion is formed in said one of said elongated front and back members during said molding thereof of said moldable plastic material.

8. The invention according to claim 1, wherein said elongated front and back members are each fabricated by molding a moldable plastic material, said laterally recessed portion and said laterally-protruding discontinuity being formed in said respective elongated front and back members during the molding thereof, said laterally-protruding discontinuity being snapped into said interlocking relationship with said laterally recessed portion during said assembly of said elongated front and back members.

9. The invention according to claim 1, wherein said laterally recessed portion is formed in said elongated back member, said laterally-protruding discontinuity being formed in said elongated front member.

10. The invention according to claim 9, wherein said laterally-protruding discontinuity is formed in said elongated front member without creating an opening through the material thereof.

11. The invention according to claim 9, wherein said laterally recessed portion is formed in said elongated back member without creating an opening through the material thereof.

12. The invention according to claim 1, wherein said laterally recessed portion is formed in said elongated front member, said laterally-protruding discontinuity being formed in said elongated back member.

13. The invention according to claim 12, wherein said laterally-protruding discontinuity is formed in said elongated back member without creating an opening through the material thereof.

14. The invention according to claim 12, wherein said laterally recessed portion is formed in said elongated front member without creating an opening through the material thereof.

15. A display holder having a plurality of frame sections forming a frame structure for receiving and holding a display piece, each of said sections having an elongated front member and an elongated back member adapted to be assembled in a pivotal relationship with one another, said front member and said back member being provided with coacting hinge formations integral therewith and in mating pivotal engagement with one another, the improvement comprising in combination first channel means formed in said back member, second channel means formed in said front members, and a spring means positioned in and extending between said first and second channel means, said spring means comprising a generally planar piece of material without any bends or folds therein, and said first channel means substantially enclosing one end of said spring means and having an arcuate-shaped center portion flanked on both sides by substantially flat wall portions, one of said front and back members having a laterally recessed portion formed at a predetermined longitudinal position therein, the other of said front and back members having a laterally-protruding discontinuity formed at a longitudinal position thereon corresponding to said predetermined longitudinal position of said laterally recessed portion when said front and back members are assembled, said laterally-protruding discontinuity being longitudinally interlockingly received within said laterally recessed portion in order to provide a longitudinally interlocking interference and to substantially prevent longitudinal movement of said front and back members relative to one another when assembled.

16. The invention according to claim 15, wherein said front and back members are adapted to be assembled in a pivotal relationship relative to one another for relative pivotal movement throughout a range of relatively pivoted positions, said laterally-protruding discontinuity being longitudinally interlockingly received in said laterally recessed portion in order to provide a longitudinally interlocking interference and to substantially prevent said relative longitudinal movement throughout said range of relatively pivoted positions.

17. The invention according to claim 15, wherein said display holder is fabricated by first forming said laterally recessed portion at said predetermined longitudinal position in said one of said front and back members, assembling said front and back members, and forming said laterally-protruding discontinuity at said corresponding longitudinal position on said other of said front and back members after said assembly in order to substantially assure that said laterally-protruding discontinuity is longitudinally interlockingly received in said laterally recessed portion when said front and back members are assembled.

18. The invention according to claim 17, wherein said laterally-protruding discontinuity is formed by a staking operation in order to yieldably deform a portion of the material of said other of said front and back members in a lateral direction toward said recessed portion on said one of said front and back members.

19. The invention according to claim 17, wherein said laterally-protruding discontinuity is formed by an operation including heating a portion of the material of said other of said front and back members at said corresponding longitudinal position thereon, and yieldably deforming said heated portion in a lateral direction toward said recessed portion on said one of said front and back members.

20. The invention according to claim 15, wherein said laterally-protruding discontinuity is formed in said one of said front and back members without creating an opening through the material thereof.

21. The invention according to claim 15, wherein said laterally recessed portion is formed in said other of said front and back members without creating an opening through the material thereof.

22. A poster display frame having a plurality of frame sections for receiving, holding and displaying a display indicia, each of said frame sections comprising a front member and back member hinged together in a pivotal relationship to one another and a spring for biasing the front and back members together and holding them in closed and open positions for respectively clamping in place and removing said display indicia, said front member and said back member having coacting hinge formatins integral therewith and in mating pivotal engagement with one another, said spring extending between said front and back members and positioned in channels in each of said front and back members, the improvement wherein said channel in said back member has an arcuate-shaped center portion and two substantially flat side wall portions substantially enclosing one end of said spring in order to allow said one end of said spring to move in said channel in said back member but not be dislodged therefrom during pivotal operation of said front and back members, one of said front and back members having a laterally recessed portion formed at a predetermined longitudinal position therein, the other of said front and back members having a laterally-protruding discontinuity formed at a longitudinal position thereon corresponding to said predetermined longitudinal position of said laterally recessed portion when said front and back members are assembled, said laterally-protruding discontinuity being longitudinally interlockingly received within said laterally recessed portion in order to provide a longitudinally interlocking interference and to substantially prevent longitudinal movement of said front and back members relative to one another when assembled.

23. The invention according to claim 22, wherein said front and back members are adapted to be assembled in a pivotal relationship relative to one another for relative pivotal movement throughout a range of relatively pivoted positions, said laterally-protruding discontinuity being longitudinally interlockingly received in said laterally recessed portion in order to provide a longitudinally interlocking interference and to substantially prevent said relative longitudinal movement throughout said range of relatively pivoted positions.

24. The invention according to claim 22, wherein said display holder is fabricated by first forming said laterally recessed portion at said predetermined longitudinal position in said one of said front and back members, assembling said front and back members, and forming said laterally-protruding discontinuity at said corresponding longitudinal position on said other of said front and back members after said assembly in order to substantially assure that said laterally-protruding discontinuity is longitudinally interlockingly received in said laterally recessed portion when said front and back members are assembled.

25. The invention according to claim 24, wherein said laterally-protruding discontinuity is formed by a staking operation in order to yieldably deform a portion of the material of said other of said front and back members in a lateral direction toward said recessed portion on said one of said front and back members.

26. The invention according to claim 24, wherein said laterally-protruding discontinuity is formed by an operation including heating a portion of the material of said other of said front and back members at said corresponding longitudinal position thereof, and yieldably deforming said heated portion in a lateral direction toward said recessed portion on said one of said front and back members.

27. The invention according to claim 22, wherein said laterally-protruding discontinuity is formed in said one of said front and back members without creating an opening through the material thereof.

28. The invention according to claim 22, wherein said laterally recessed portion is formed in said other of said front and back members without creating an opening through the material thereof.

29. A display holder having a plurality of frame sections forming a frame structure for receiving and holding a display piece, each of said frame sections having a pair of front and back members adapted to be assembled in a pivoted relationship with one another, said front and back members being provided with coacting hinge formations integral therewith and in mating pivotal engagement with one another, the improvement comprising in combination first channel means formed in said back member, second channel means formed in said front member, and a spring means positioned in and extending between said first and second channel means, said spring means comprising a generally planar piece of material without any bends or folds therein and having a length greater than the distance between said first and second channel means so that said spring means is bowed when positioned therebetween, and said first channel means substantially enclosing one end of said spring means, one of said front and back members having a laterally recessed portion formed at a predetermined longitudinal position therein, the other of said front and back members having a laterally-protruding discontinuity formed at a longitudinal position thereon corresponding to said predetermined longitudinal position of said laterally recessed portion when said front and back members are assembled, said laterally-protruding discontinuity being longitudinally interlockingly received within said laterally recessed portion in order to provide a longitudinally interlocking interference and to substantially prevent longitudinal movement of said front and back members relative to one another when assembled.

30. The invention according to claim 29, wherein said front and back members are adapted to be assembled in a pivotal relationship relative to one another for relative pivotal movement throughout a range of relatively pivoted positions, said laterally-protruding discontinuity being longitudinally interlockingly received in said laterally recessed portion in order to provide a longitudinally interlocking interference and to substantially prevent said relative longitudinal movement throughout said range of relatively pivoted positions.

31. The invention according to claim 29, wherein said display holder is fabricated by first forming said laterally recessed portion at said predetermined longitudinal position in said one of said front and back members, assembling said front and back members, and forming said laterally-protruding discontinuity at said corresponding longitudinal position on said other of said front and back members after said assembly in order to substantially assure that said laterally-protruding discontinuity is longitudinally interlockingly received in said laterally recessed portion when said front and back members are assembled.

32. The invention according to claim 31, wherein said laterally-protruding discontinuity is formed by a staking operation in order to yieldably deform a portion of the material of said other of said front and back members in a lateral direction toward said recessed portion on said one of said front and back members.

33. The invention according to claim 31, wherein said laterally-protruding discontinuity is formed by an operation including heating a portion of the material of said other of said front and back members at said corresponding longitudinal position thereon, and yieldably deforming said heated portion in a lateral direction toward said recessed portion on said one of said front and back members.

34. The invention according to claim 29, wherein said laterally-protruding discontinuity is formed in said one of said front and back members without creating an opening through the material thereof.

35. The invention according to claim 29, wherein said laterally recessed portion is formed in said other of said front and back members without creating an opening through the material thereof.

36. A display holder having a plurality of frame sections forming a frame structure for receiving and holding a display piece, each of said sections having an elongated front member and an elongated back member adapted to be assembled in a pivotal relationship with one another, said front member and said back member being provided with coacting hinge formations integral therewith and in mating pivotal engagement with one another, the improvement comprising one of said front and back members having a laterally recessed portion formed at a predetermined longitudinal position thereon, the other of said front and back members having a laterally-protruding discontinuity formed at a longitudinal position thereon corresponding to said predetermined longitudinal position of said laterally recessed portion when said front and back members are assembled, said laterally-protruding discontinuity being longitudinally interlockingly received within said laterally recessed portion in order to substantially prevent longitudinal movement of said front and back members relative to one another when assembled.

37. A display holder having a plurality of frame sections forming a frame structure for receiving and holding a display piece, each of said frame sections having a pair of front and back members adapted to be assembled in a pivoted relationship with one another and spring means for biasing the front and back members together and for holding them in open and closed positions for respectively removing and clamping in place said display piece, said front and back members being provided with coacting hinge formations integral therewith and in mating pivotal engagement with one another, the improvement comprising one of said front and back members having a laterally recessed portion formed at a predetermined longitudinal position therein, the other of said front and back members having a laterally-protruding discontinuity formed at a longitudinal position thereon corresponding to said predetermined longitudinal position of said laterally recessed portion when said front and back members are assembled, said laterally-protruding discontinuity being longitudinally interlockingly received within said laterally recessed portion in order to substantially prevent longitudinal movement of said front and back members relative to one another when assembled.

* * * * *

UNITED STATES PATENT AND TRADEMARK OFFICE

CERTIFICATE OF CORRECTION

PATENT NO. : 4,937,959

DATED : July 3, 1990

INVENTOR(S) : Randall Palmer

It is certified that error appears in the above-identified patent and that said Letters Patent is hereby corrected as shown below:

Column 1, Line 51, "dist" should be --dust--.

Column 3, Line 11, "high" should be --hinge--.

Column 3, Line 33, "numberal" should be --numberal--

Column 9, Line 61, Claim 26, "thereof" should be --thereon--.

Signed and Sealed this

First Day of October, 1991

*Attest:*

*Attesting Officer*

HARRY F. MANBECK, JR.

*Commissioner of Patents and Trademarks*